US010202900B2

(12) United States Patent
Schaffrath et al.

(10) Patent No.: US 10,202,900 B2
(45) Date of Patent: Feb. 12, 2019

(54) POSITIONING THE SWITCHING ELEMENT FOR A MECHANICALLY SWITCHED VCR CONNECTING ROD

(71) Applicant: FEV GmbH, Aachen (DE)

(72) Inventors: Uwe Schaffrath, Herzogenrath (DE); Christoph Muller, Norvenich (DE); Paul Grzeschik, Aachen (DE)

(73) Assignee: FEB GmbH, Aachen (DE)

( * ) Notice: Subject to any disclaimer, the term of this patent is extended or adjusted under 35 U.S.C. 154(b) by 107 days.

(21) Appl. No.: 15/311,124

(22) PCT Filed: May 15, 2015

(86) PCT No.: PCT/EP2015/060794
§ 371 (c)(1),
(2) Date: Nov. 14, 2016

(87) PCT Pub. No.: WO2015/173411
PCT Pub. Date: Nov. 19, 2015

(65) Prior Publication Data

US 2017/0089257 A1 Mar. 30, 2017

(30) Foreign Application Priority Data

May 15, 2014 (DE) ..... 10 2014 007 051

(51) Int. Cl.
*F02D 15/02* (2006.01)
*F02B 75/04* (2006.01)

(52) U.S. Cl.
CPC ..... *F02B 75/045* (2013.01); *F02D 15/02* (2013.01)

(58) Field of Classification Search
CPC ..... F02B 75/045; F02D 15/02
See application file for complete search history.

(56) References Cited

U.S. PATENT DOCUMENTS 2,989,954 A 6/1961 Hulbert
2002/0117129 A1* 8/2002 Aoyama ..... F01B 9/02 123/48 B (Continued)

FOREIGN PATENT DOCUMENTS

DE 19703948 C1 6/1998
DE 102005055199 A1 5/2007

(Continued)

OTHER PUBLICATIONS

International Search Report dated Jul. 20, 2015, International Application PCT/EP2015/060794, filed May 15, 2015.

*Primary Examiner* — Jacob Amick
*Assistant Examiner* — Charles Brauch
(74) *Attorney, Agent, or Firm* — Dinsmore & Shohl LLP

(57) ABSTRACT

The invention relates to an internal combustion engine having an adjustable variable compression ratio, a crankshaft having a crankshaft center line and at least one counterweight, which has an extent with a maximum distance from the crankshaft center line, at least one connecting rod, an adjusting mechanism for adjusting the adjustable variable compression ratio, a switchover element for switching the adjusting mechanism, wherein the switchover element is arranged on the connecting rod, and an actuating element for switching over the switchover element from a first position, which corresponds to a first compression ratio, into a second position.

6 Claims, 9 Drawing Sheets

(56) References Cited

U.S. PATENT DOCUMENTS

| | | | | |
|---|---|---|---|---|
| 2004/0261733 | A1* | 12/2004 | Henig | F02B 75/045 123/78 E |
| 2011/0120421 | A1* | 5/2011 | Engineer | F02B 75/045 123/48 B |
| 2012/0085309 | A1* | 4/2012 | Cleeves | F01L 5/06 123/188.5 |

FOREIGN PATENT DOCUMENTS

| | | | |
|---|---|---|---|
| DE | 102011108790 | A1 | 1/2013 |
| DE | 102012014917 | A1 | 2/2013 |
| DE | 102011056298 | A1 | 6/2013 |
| DE | 102012020999 | A1 | 1/2014 |
| WO | 2014019683 | A1 | 2/2014 |
| WO | 2014019684 | A1 | 2/2014 |

* cited by examiner

POSITIONING THE SWITCHING ELEMENT FOR A MECHANICALLY SWITCHED VCR CONNECTING ROD

CROSS-REFERENCE TO RELATED APPLICATIONS

This application is a U.S. National Phase of PCT/EP2015/060794 filed May 15, 2015, which claims priority of German Patent Application 10 2014 007 051.4 filed May 15, 2014, the contents of which are herewith incorporated by reference into the subject matter of the present patent application.

FIELD OF THE INVENTION

The present invention relates to a reciprocating piston engine having an internal combustion engine which is operated having a variable compression ratio controlled by a switchover element.

BACKGROUND

The invention relates to an internal combustion engine having an adjustable variable compression ratio, a crankshaft having a crankshaft center line and at least one counterweight, which has an extent with a maximum distance from the crankshaft center line, at least one connecting rod, an adjusting mechanism for adjusting the adjustable variable compression ratio, a switchover element or a control valve for switching the adjusting mechanism, wherein the switchover element is arranged on the connecting rod, and an actuating element for switching over the switchover element from a first position, which corresponds to a first compression ratio, into a second position.

An internal combustion engine of this kind is known from WO-A-2014/019684 and WO-A-2014/019683. In the case of the internal combustion engine according to WO-A-2014/019684, a switchover element for switching the adjusting mechanism is arranged on the bottom end of the connecting rod. An actuating element for switching over the switchover element, which actuating element does not move with the crankshaft or the connecting rod, is furthermore arranged in the region of the bottom dead center position of the connecting rod and to the side of the connecting rod. In internal combustion engines having relatively large counterweights on the crankshaft for mass balancing, such a design is found to be too complex in view of the limited installation space. Moreover, such a design does not offer sufficient installation space, and hence allows too few variants for possible arrangements of the switchover element relative to the actuating element, to modify or optimize the geometrical shape of the actuating element, designed in the manner of a cam disk, along the trajectory described by the switchover element during a revolution of the connecting rod, e.g. to optimize it as regards a reduced impact when the switchover element strikes the actuating element.

Further internal combustion engines having a variable compression ratio are known from DE-A-10 2011 108 790, DE-A-10 2012 014 917 and U.S. Pat. No. 2,989,954.

SUMMARY OF INVENTION

It is therefore the object of the present invention to provide a reciprocating piston engine, in particular an internal combustion engine of the type stated at the outset, in which the number of possible variants for arrangement of the switchover element or the control valve and of the associated actuating element for switching the adjusting mechanism is increased.

According to the invention, this object is achieved by an internal combustion engine having the features of patent claim 1. Advantageous embodiments with expedient developments of the invention will become apparent from the remaining patent claims, the description and the figures.

Thus, the proposal according to the invention is that the actuating element for the actuation, in particular mechanical actuation, of the switchover element, by means of which, in turn, the switch for adjusting the compression ratio is switched over, is arranged outside that region of the crankshaft which said crankshaft, together with the design elements thereof, such as counterweights, crankpins, bearing journals etc., occupies during rotation. The connecting rod provided with the adjusting mechanism now has a connecting rod portion in the region of the crankshaft connecting-rod bearing or around said bearing which is outside the region or space described above during a revolution of the connecting rod, more specifically for at least part of the connecting rod revolution. If, according to the invention, the switchover means is now arranged in said connecting rod portion, it is possible to act upon it by means of the actuating element from outside the crankshaft. The actuating element has actuating or contact surfaces, in particular two such surfaces, in order namely to transfer the switchover means out of a first position into a second position and vice versa. It is expedient if the switchover means extends beyond a different side of the connecting rod in each of the two positions of said switchover means. If the actuating element is now expediently designed in the manner of a fixed cam disk, i.e. a cam disk which does not rotate with the connecting rod or the crankshaft, and this cam disk can be moved forward and backward parallel to the crankshaft center line since it is arranged outside the space occupied by the crankshaft, the switchover element can be actuated mechanically in each case by a different one of two actuating surfaces of the cam disk (of the actuating element).

In the context of the invention, it is likewise possible for the actuating element to act on the switchover element in a manner other than mechanical. Thus, for example, magnetic solutions (e.g. inductively operating switches or, alternatively, other contactless operating switches, such as capacitive or optical switches) can be used, wherein in that case the corresponding actuating elements and switchover elements can also be designed accordingly.

In order to provide an internal combustion engine in which the number of possible variants for arrangement of the actuating element relative to the switchover element for the switch of the adjusting mechanism is increased, a proposal according to a development/variant of the invention is that the switchover element is arranged on the connecting rod in such a way that, during a revolution of the connecting rod, it describes a trajectory which intersects a circle ("orbit") with a radius equal to the maximum distance of the counterweight from the crankshaft center line. In that case, the switchover element is situated outside the orbital path of the counterweight, where the actuating element can be accommodated with relatively few problems (degrees of design freedom), for a certain segment of its trajectory curve during a revolution of the connecting rod. The position of the actuating element can advantageously be combined with the embodiment of the actuating or switching surface which is formed on the actuating element and along which the switchover element slides or which it strikes when the actuating element is moved into the trajectories of the switchover element for actuating the switchover element.

The crankshaft typically has at least one shaft journal and one crankpin. For mass balancing of first- and second-order forces and torques, to which the crankshaft is exposed during operation of the internal combustion engine, counterweights are arranged on the crankshaft. Depending on the engine design of the internal combustion engine, the counterweights are of different sizes. In this case, the counterweights are each at very different distances from a crankshaft center line around which the crankshaft rotates. During the rotation of the crankshaft, the respective counterweight moves over a circular area. In the sense according to the invention, a part of the counterweight in the form of a point which is at a distance or the maximum distance from the crankshaft center line defines the extent with the maximum distance from the crankshaft center line. In the case of an in-line five-cylinder engine, the maximum distance is relatively large, for example, because the first- and second-order torques to be balanced are relatively high. The counterweight of the crankshaft can be shaped in different ways, wherein the shape of the counterweight has at least one extent with a maximum distance from the crankshaft center line. In the case of a counterweight of partially circular design, it is also possible for the counterweight to have several extents with the same maximum distance.

A circle with a radius which is equal to this maximum distance encloses each point in a two-dimensional plane which is traversed in a rotation of the counterweight during a revolution of the connecting rod. In a three-dimensional view, a cylinder formed by a circle having a radius equal to the maximum distance and a central point which lies on the crankshaft center line encloses each point which the counterweight covers during one complete rotation of the crankshaft in space.

According to the invention, the actuating element for switching over the switchover element and hence the switch, said actuating element being fixed with respect to the rotation of the crankshaft and the revolution of the connecting rod, is preferably arranged outside this cylinder. To reach this actuating element, the switchover element moves over a trajectory which intersects the abovementioned circle or cylinder at least once during a complete revolution of the connecting rod. Such an arrangement of the switchover element on the connecting rod enables the actuating element to be made larger in the axial direction of the crankshaft and therefore also enables the shape of the actuating element to be optimized. In contrast to the prior art, such optimization can be performed independently of the design of the internal combustion engine, in particular independently of the dimensioning of the counterweights of the internal combustion engine.

In a particularly advantageous embodiment of the subject matter of the invention, it is envisaged that the connecting rod has a connecting rod bearing cap and the switchover element is provided on the connecting rod bearing cap. The connecting rod has a connecting rod bearing eye in which the pin of a compression piston is mounted. The connecting rod furthermore has a connecting rod shank and a connecting rod big end, wherein the connecting rod bearing cap is secured on the connecting rod big end, and the connecting rod bearing cap and the connecting rod big end form a connecting rod head in which the crankshaft is mounted. The connecting rod is preferably forged as a single piece, wherein the connecting rod preferably comprises a carbon steel, e.g. C 35 and C 45, or a high-alloy steel, e.g. chromium, molybdenum, nickel or vanadium, which is particularly preferably heat-treated. The connecting rod can furthermore be produced from a malleable cast iron, e.g. GTS 70. In a development, the connecting rod can be embodied as a forged/sintered connecting rod. In a special embodiment, the connecting rod comprises titanium. As a particularly preferred option, a sintered receptacle for the switchover element is provided on the connecting rod. The receptacle preferably allows a movement of a switchover element for the switching element in the axial direction of the crankshaft, more specifically completely irrespective of the choice of material and production of the connecting rod.

In a development of the subject matter of the invention, the connecting rod bearing cap is secured on the connecting rod big end by means of a first and a second screw, and the switchover element is provided on the connecting rod bearing cap between the two screws. As a particularly preferred option, the switchover element projects beyond a line connecting the two screw heads, preferably with a spacing of at least ½ cm, in a further embodiment of 1 cm, in an embodiment modified with respect thereto of 2 cm, and in another embodiment of 3 cm.

In a further embodiment, it is envisaged that the connecting rod has a connecting rod big end, the connecting rod bearing cap is secured on the connecting rod big end by means of a first and a second screw, and one of the two screws, the first or the second screw, is provided between the switchover element and the other screw, either the second or, correspondingly, the first screw. In an advantageous manner, the switchover element is arranged on a narrow side face of the connecting rod head, wherein the connecting rod head has a wide side face, through which the crankshaft passes, and a narrow side face, which is preferably parallel to the crankshaft axis. A special variant of this embodiment envisages that the switchover element is provided on the connecting rod big end. In a special production method, a receptacle for the switchover element can be produced on the connecting rod bearing cap after the connecting rod head has been broken apart. A further special embodiment envisages that the switchover element is arranged on the connecting rod bearing cap and simultaneously on the narrow side face, wherein, between the switchover element and the first or second screw, the other screw in each case, either the second or, correspondingly, the first screw, is provided.

In a preferred embodiment, the switchover element is spaced apart from the screw center line of the nearest screw, i.e. the first or second screw, by a distance of at least ½ cm, in a further embodiment at least 1 cm, in a modification different therefrom at least 1.5 cm and, in a further embodiment, at least 2 cm.

An advantageous embodiment envisages that the internal combustion engine is an in-line engine. In particular, the internal combustion engine can be embodied as a 4-, 5-, 6- or 8-cylinder in-line engine. A special embodiment envisages that the internal combustion engine is embodied as a horizontally opposed engine. The internal combustion engine can advantageously be embodied as a 4-, 6- or 8-cylinder horizontally opposed engine.

A development envisages that the internal combustion engine has two cylinder banks, which are arranged in a V shape relative to one another. More specifically, the two cylinder banks can have an angle of 90°, wherein the internal combustion engine can be embodied as a 4-, 5-, 6- or 8-cylinder engine.

Moreover, a method is proposed for switching over an adjustable variable compression ratio of an internal combustion engine having a crankshaft with a crankshaft center line and at least one counterweight, which has an extent with a maximum distance from the crankshaft center line, a connecting rod, an actuating element and an adjusting mechanism for adjusting the variable compression ratio, wherein a switchover element for switching the adjusting mechanism is arranged on the connecting rod. In a first step of this method, the actuating element is moved from a first into a second or from a second into a first actuating position in each case. In a second step, the connecting rod is allowed to revolve until the switchover element of the connecting rod can touch the actuating element at a first point of contact, depending on the position of the actuating element, wherein the switchover element has a trajectory, during a complete revolution of the connecting rod, which intersects a circle having a radius which is equal to the maximum distance. If the compression ratio is to be shifted, the actuating element is brought into operative connection with the switchover element within the interval during which the switchover element moves along its curve segment extending outside the circumference.

BRIEF DESCRIPTION OF DRAWINGS

Further advantages, features and details of the invention will emerge from the following description of a preferred illustrative embodiment and with reference to the figures.

DETAILED DESCRIPTION OF THE PREFERRED EMBODIMENTS

Figure 1:
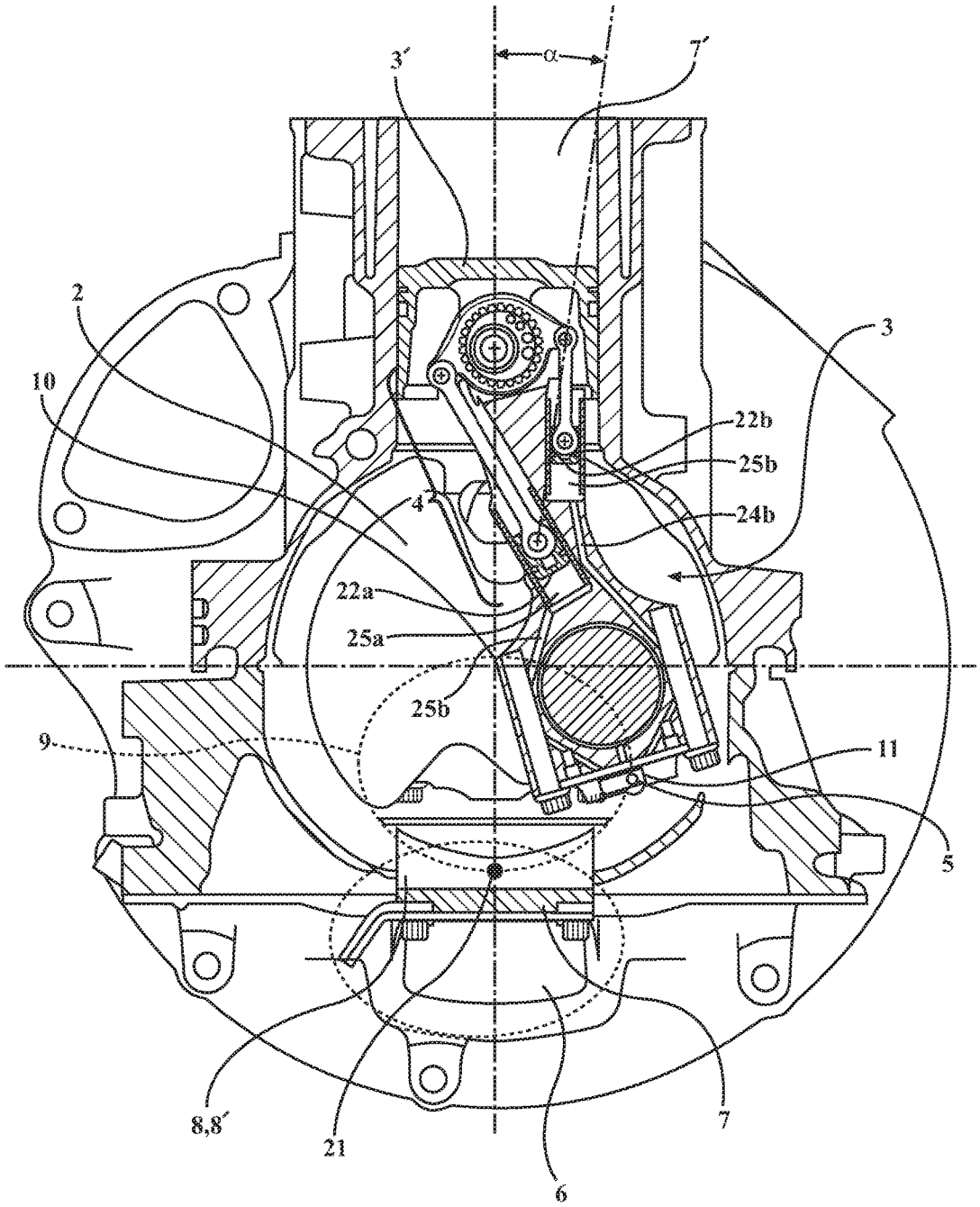
FIG. 1 illustrates a section through an internal combustion engine having an adjustable variable compression ratio, a crankshaft, a connecting rod, an adjusting mechanism for adjusting the adjustable variable compression ratio, and a switchover element.

FIG. 1 is an internal combustion engine having a housing 1 with a variably adjustable compression ratio, a crankshaft 2, at least one connecting rod 3, an adjusting mechanism 4 for adjusting the adjustable compression ratio, and a switchover element or, alternatively, a control valve 5 for a switch (not shown in FIG. 1, but see FIG. 2, for example) for switching the adjusting mechanism 4. The switchover element or the control valve 5 is arranged on the connecting rod 3. The connecting rod 3 has a connecting rod shank, on which the connecting rod eye supporting the compression piston 3' is formed, and a connecting rod cap 3, which surrounds the crankshaft pin. Moreover, a holder 6, which can be moved forward and back parallel to the extent of the crankshaft center line and on which an actuating element 7 having two actuating surfaces 8, 8' for alternately acting mechanically on the switchover element or the control valve 5 as the latter is moved past the actuating element 7 during a revolution of the connecting rod 3 is arranged, is preferably provided in a region close to the bottom dead center position of the connecting rod 3. The actuating surfaces 8, 8' bring about switching over of the switchover element or the control valve 5 and hence of the switch out of the first switching position thereof into the second switching position thereof, while actuating surface 8' actuates the switchover element or the control valve 5 in order to transfer the switch out of the second switching position thereof into the first switching position thereof.

Figure 2:
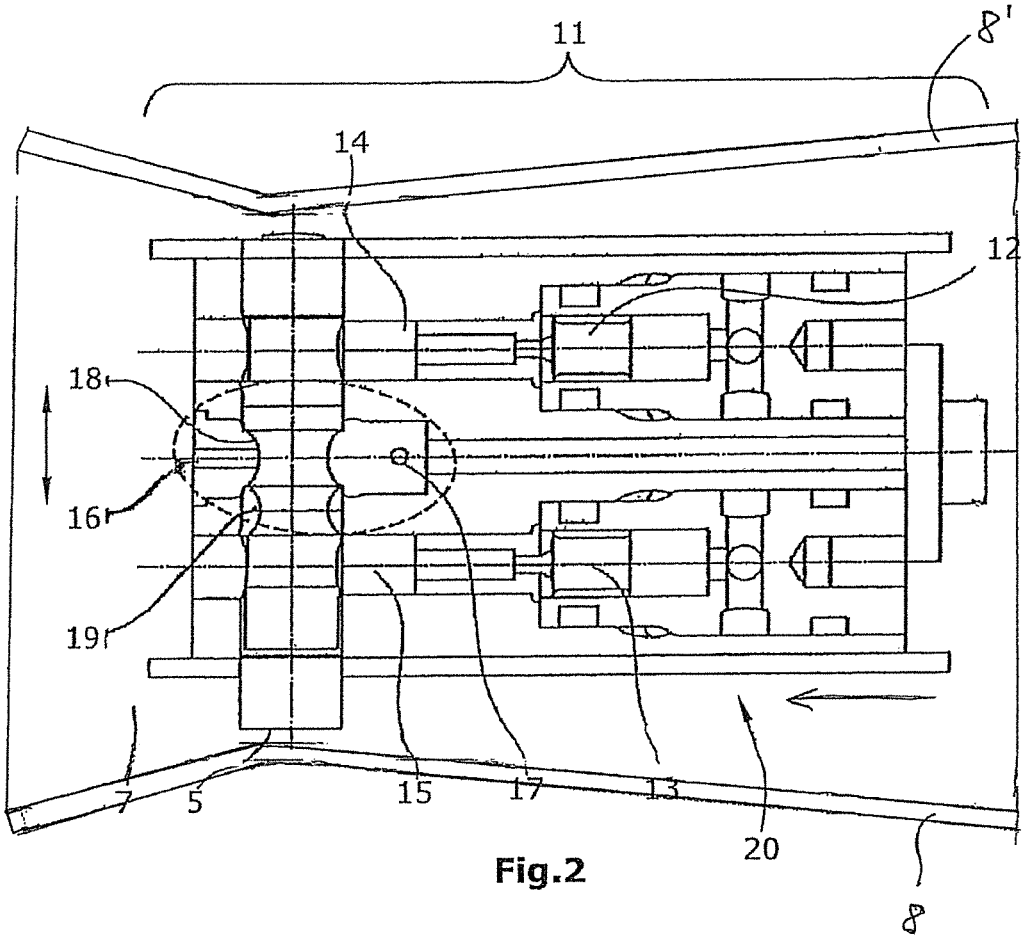
FIG. 2 is a section through the switchover element.

In a special embodiment, the switchover element or control valve 5 can activate a switch 20 in the form of a hydraulic directional control valve for hydraulic control of a working chamber, as embodied in FIG. 1 of DE-A-10 2005 055 199 as working chamber 29.1 or 29.2, for example. In particular, the switchover element or the control valve 5 can activate a hydraulic directional control valve, which in each case opens to an outflow bore associated with one working chamber. An outflow bore of this kind is shown in FIG. 2 of DE-A-10 2005 055 199 as an outflow bore 36, for example. The hydraulic directional control valve has at least two switch controls, which correspond respectively to a first position of the switch 20 and a second position of the switch 20. In U.S. Pat. No. 9,677,469, different possibilities for interconnecting a hydraulic directional control valve are described. Reference is made to the entire contents of this document in respect of a possible embodiment of the hydraulic circuit in the connecting rod and in respect of the design of the circuit in the connecting rod as part of the disclosure of the present application, and therefore the contents of U.S. Pat. No. 9,677,469 belong to the subject matter of the present application. Specifically, the adjusting mechanism 4 includes a pair of pistons 22*a*, 22*b* mounted to the connecting rod 3. The pair of pistons 22*a*, 22*b* each include a working chamber 25*a*, 25*b*. A two-way directional valve 11 is in fluid communication with the pair of pistons 22*a*, 22*b* via a pair of fluid channels 24*a*, 24*b*, which are in fluid communication with the working chambers 25*a*, 25*b* of the pair of pistons 22*a*, 22*b*. The directional valve 11 is configured to switch a pressure between the pair of pistons 22*a*, 22*b* so to adjust the adjustment mechanism 4.

FIG. 2 furthermore shows interaction of the switchover element 5 with a hydraulic directional control valve as a three/two-way valve 11 or, more generally, with the switch 20. Here, the three/two-way valve function is implemented through the interaction of a first two/two-way valve 12 and of a second two/two-way valve 13. The two/two-way valves 12 and 13 can be embodied as seat valves, e.g. by means of a ball check valve, which can be pushed open by means of a tappet. A first tappet 14 is assigned to the first two/two-way valve 12. A second tappet 15 is furthermore associated with the second two/two-way valve. The two tappets 14 and 15 can be controlled by the switchover element 5. The switchover element 5 can be held firmly in a particular switching position by means of a latching device 16. The latching device 16 can be implemented by means of a sprung pressure piece 17 and a first latching contour 18 formed on the switchover element 5. To ensure that the tappets do not accidentally open the two/two-way valves under the influence of inertia forces, the tappets are pressed against the switchover element 5 by springs. In addition to the first latching contour 18, the latching device 16 has a second latching contour 19. In interaction with the sprung pressure piece 17, latching contour 18 holds the switchover element 5 in a first position. In interaction with the sprung pressure piece 17, latching contour 19 holds the switchover element 5 in a second position. By moving the actuating element 7 in one of the two directions indicated by the double arrow in FIG. 2, the switchover element 5 and hence the switch 20 is transferred from a first switching position into a second switching position and vice versa when the connecting rod portion of the connecting rod 30 which has switchover element 5 moves past the actuating element 7 (see the individual case in FIG. 2).

Owing to the kinematic conditions, e.g. the crankshaft radius, the push rod length of the connecting rod 3 and the position of the switchover element 5 on the connecting rod 3, the switchover element 5 moves along a path of movement with a varying speed during a revolution of the connecting rod 3. In FIG. 1, an elliptical trajectory 9 of the switchover element 5 is shown for a special embodiment. At a virtually constant speed of the internal combustion engine, the speed profile obtained varies according to the position of the switchover element 5. The positions of the switchover element 5 on the trajectory 9 will be given below as a function of the rotational position of the crankshaft 2, which is described by an angle $\alpha$, in degrees of crank angle. Here, a position of the switchover element 5 at the top dead center position of the connecting rod 3 corresponds to a value of the angle $\alpha$ of 0 degrees of crank angle, wherein this point is plotted by a point 10 on the trajectory in FIG. 1. Position 21 of the switchover element 5, which lies on the trajectory 9, corresponds to a value of the angle $\alpha$ degrees of crank angle of 180.

Figure 3:
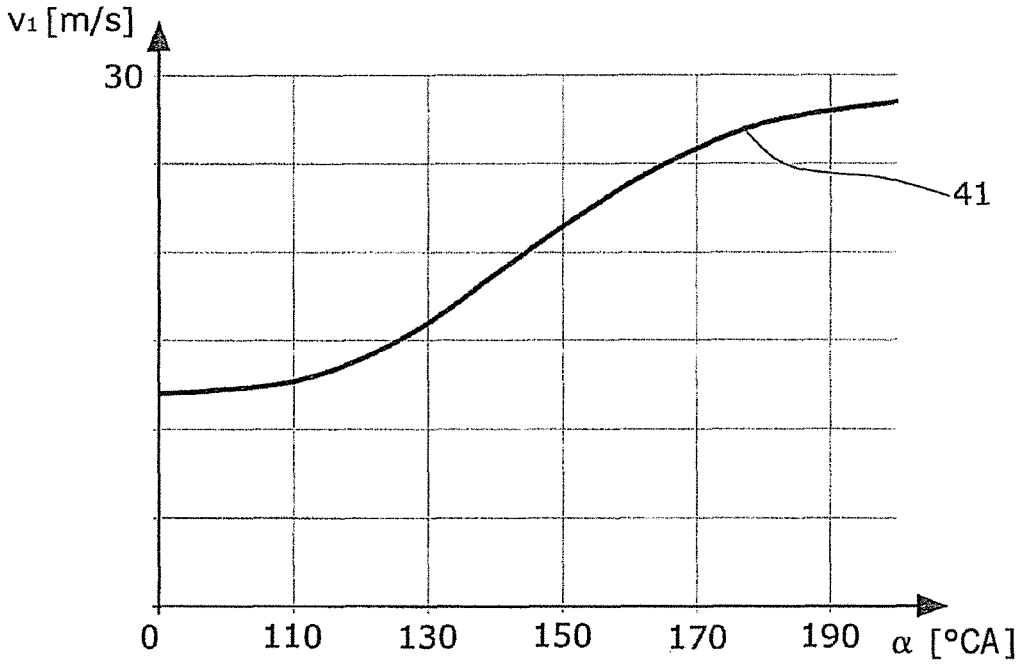
FIG. 3 is a speed profile of the switchover element over a first crankshaft range.

FIG. 3 illustrates a first qualitative speed profile 41 of the absolute speed v1 of the switchover element 5 against the angle $\alpha$ in degrees of crank angle. The absolute speed of the switchover element 5 increases in a strictly monotonic way in a crank angle range of 170 degrees to 190 degrees. At a speed of the internal combustion engine of approximately 4500 revolutions per minute, the absolute speed of the switchover element 5 preferably reaches a value of at most 30 m/s.

Figure 4:
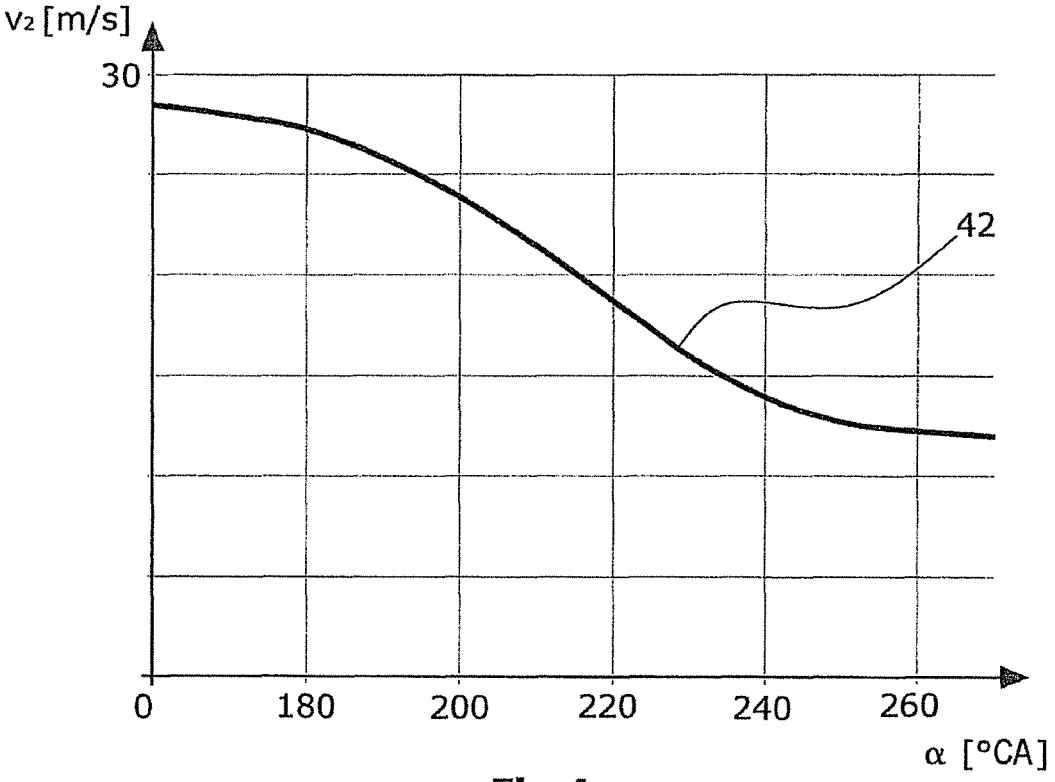
FIG. 4 is a second speed profile of the switchover element over a second crankshaft range.

FIG. 4 illustrates a second qualitative speed profile 42 of the absolute speed v2 of the switchover element 5 against the movement position thereof, given in degrees of crank angle of the angle $\alpha$. In a crank angle range of 200 degrees to 220 degrees, the absolute speed of the switchover element 5 decreases in a strictly monotonic way. At a speed of the internal combustion engine of approximately 4500 revolutions per minute, the absolute speed of the switchover element 5 preferably reaches a value of at most 30 m/s.

Positioning the switchover element 5 at the respective connecting rod positions defined in the patent claims allows not only additional installation space for more flexible configuration of the mechanical actuating element 7 for the mechanical actuation of the switchover element 5 and more flexible arrangement of the actuating element 7, but furthermore makes possible positioning of the actuating element 7 in a region in which the actuating element 7 can be adapted more easily to a speed profile of the kind illustrated, for example, by a speed profile 41 or 42.

Figure 5:
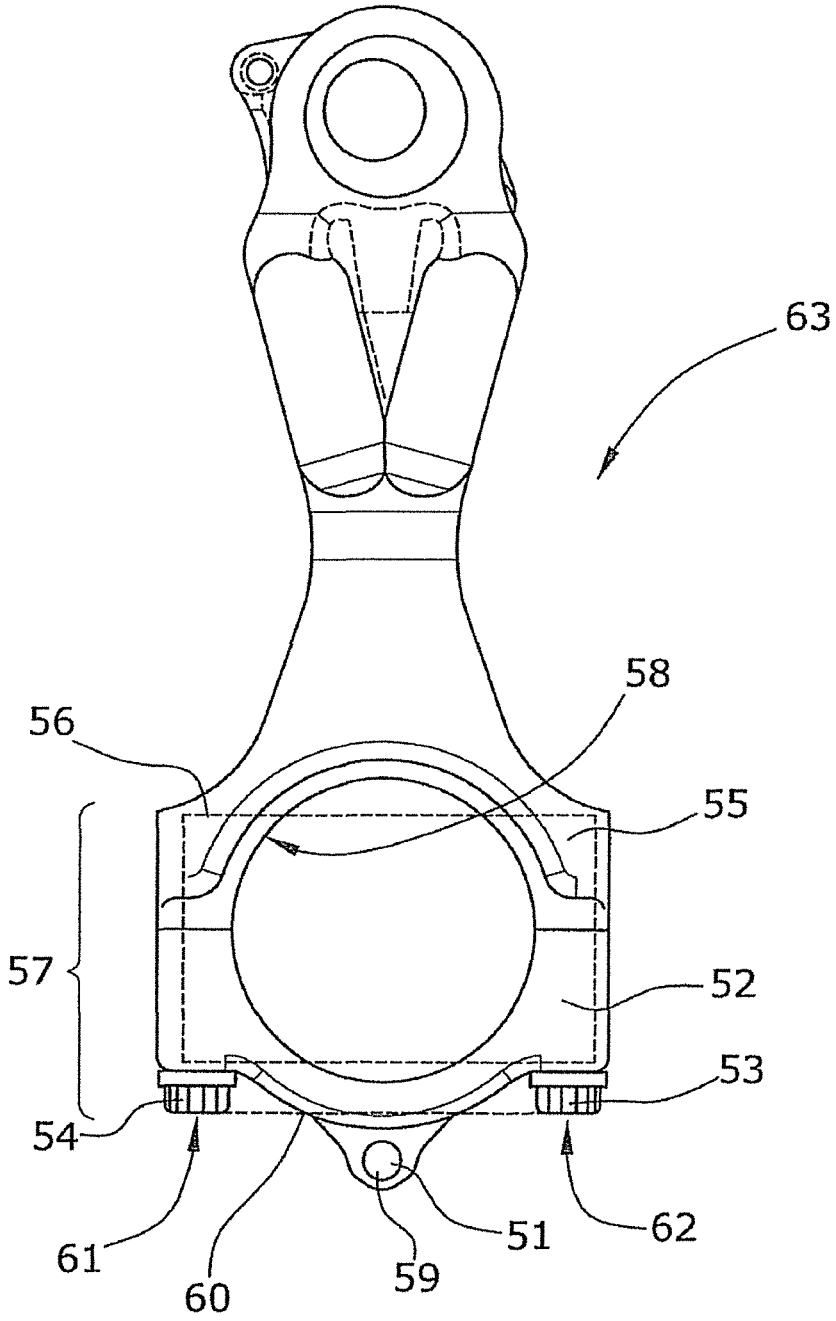
FIG. 5 is a first possible arrangement of a switchover element on a in the region of the crankshaft connecting-rod bearing in the case of an in-line engine.

FIG. 5 illustrates a first possible arrangement of a switchover element 51 on a connecting rod bearing cap 52 of a connecting rod 63, wherein the connecting rod bearing cap 52 is secured on a connecting rod big end 55 by means of a first screw 53 and a second screw 54. FIG. 5 furthermore illustrates a wide side face 56 (illustrated in dashed lines) of a connecting rod head 57, wherein the connecting rod head 57 is formed by the connecting rod bearing cap 52 and the connecting rod big end 55. The wide side face 56 is penetrated by a connecting rod bearing receptacle 58. In a special embodiment, the central point 59 of the switchover element 51 is at a distance of at least 1 cm, in another embodiment at a distance of at least 1.5 cm, and, in an embodiment modified with respect thereto, at a distance of at least 2 cm from a connecting line 60 which connects a screw head end 61 of screw 54 to a screw head end 62 of screw 53. FIG. 5 further illustrates how the switchover element 51 is arranged between the first screw 54 and the second screw 53. Such an arrangement of the switchover element 51 can advantageously be provided on an in-line engine.

Figure 6:
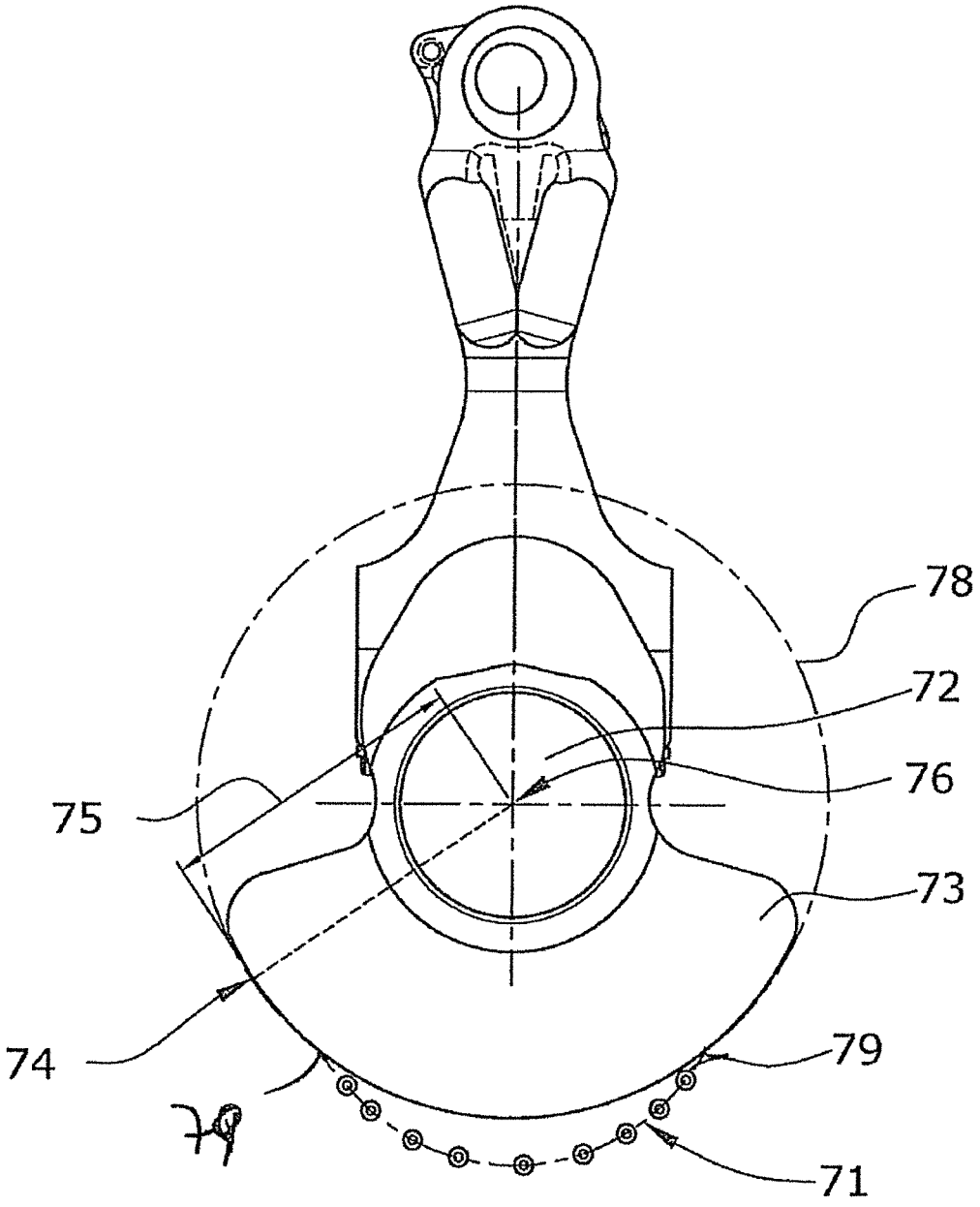
FIG. 6 is a trajectory for the switchover element of the connecting rod shown in FIG. 5.

FIG. 6 illustrates that segment of the trajectory 71 which lies outside the counterweight orbit 78 during a revolution of the connecting rod 63, by way of example for switchover element 51. FIG. 6 furthermore illustrates a crankshaft 72, on which a counterweight 73 is arranged. The counterweight 73 has at least one extent 74 with a maximum distance 75 from the crankshaft center line 76. During a revolution of the connecting rod 63, switchover element 51 also moves along the trajectory 71, which intersects the orbit 78, which has a radius that is equal to the maximum distance 75 of the extent 74 of the counterweight 73. The points of intersection of the trajectory 71 with the orbit 78 are illustrated by the points 79 in FIG. 6.

Figure 7:
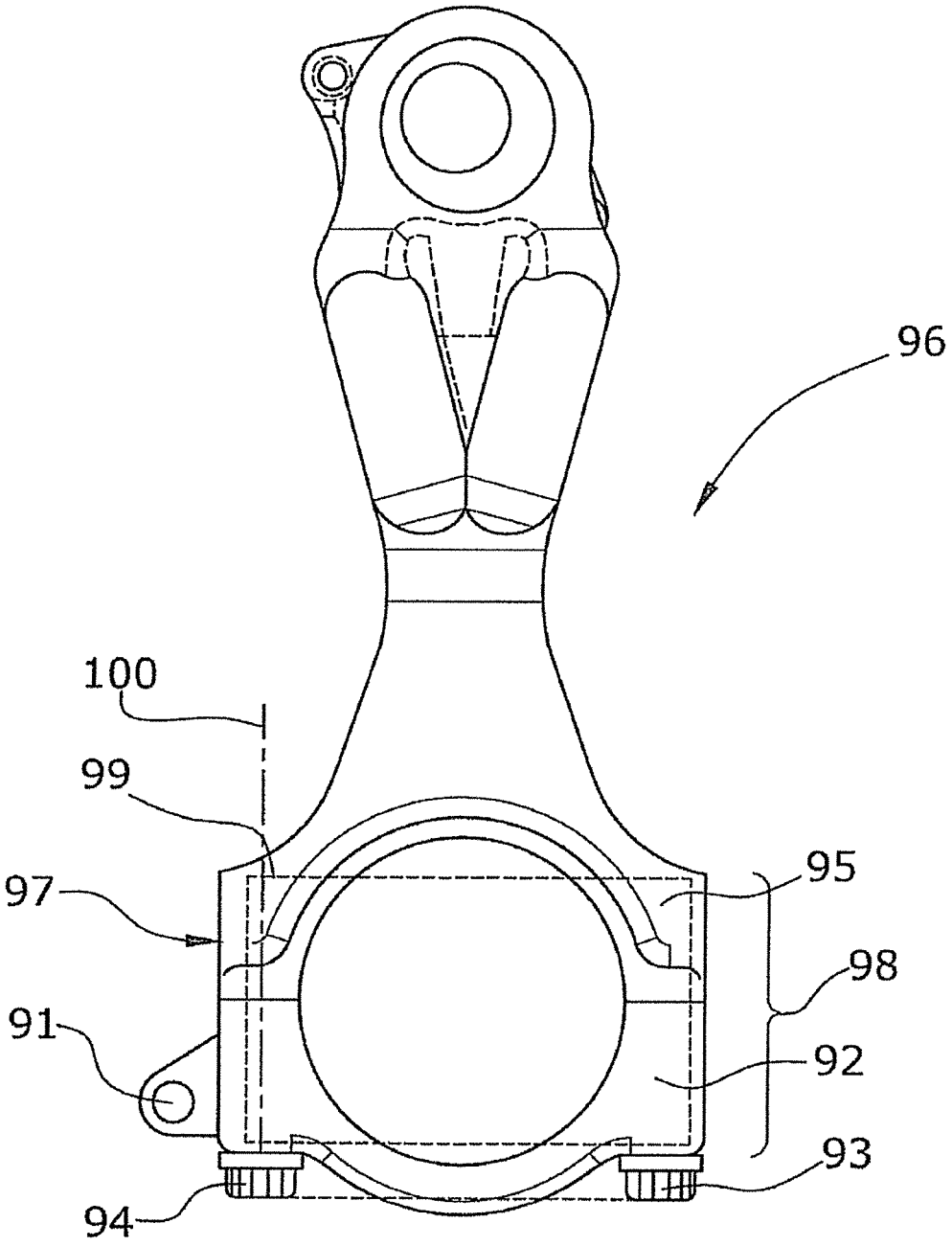
FIG. 7 is a second possible arrangement of a switchover element on a region of the crankshaft connecting-rod bearing in the case of a V engine.

FIG. 7 illustrates a second arrangement of a switchover element 91 on a connecting rod bearing cap 92 of a connecting rod 96, which is secured on a connecting rod big end 95 of the connecting rod 96 by means of a first screw 93 and a second screw 94. Switchover element 91 is provided on the connecting rod bearing cap 92, preferably on a narrow side face 97 of the connecting rod head 98, which is formed by the connecting rod bearing cap 92 and the connecting rod big end 95. A wide side face of the connecting rod head 98 is illustrated by means of the dashed line 99. The arrangement illustrated in FIG. 7 of the switchover element 91 is provided, for example, for an internal combustion engine that has cylinder banks arranged in a V shape.

In a preferred embodiment, the switchover element 91 is spaced apart from the screw center line 100 of the nearest screw 94 by a distance of at least 0.5 cm, in a further embodiment at least 1 cm, in a modification different therefrom at least 1.5 cm and, in a further embodiment, at least 2 cm.

In the case of a V engine, the connecting rod can be split obliquely between the connecting rod big end thereof and the connecting rod bearing cap thereof, which means that the parting plane does not extend in a substantially perpendicular way between the two but at an acute angle to the extent of the connecting rod. In this case, the switchover element can then also be arranged on the connecting rod big end, more specifically on that side of at least one of the two connecting elements which faces away from the crankshaft connecting-rod bearing. However, it is conventional for the switchover element on an obliquely split connecting rod of this kind to be arranged on the connecting rod bearing cap to the side of one of the two connecting elements.

Figure 8:
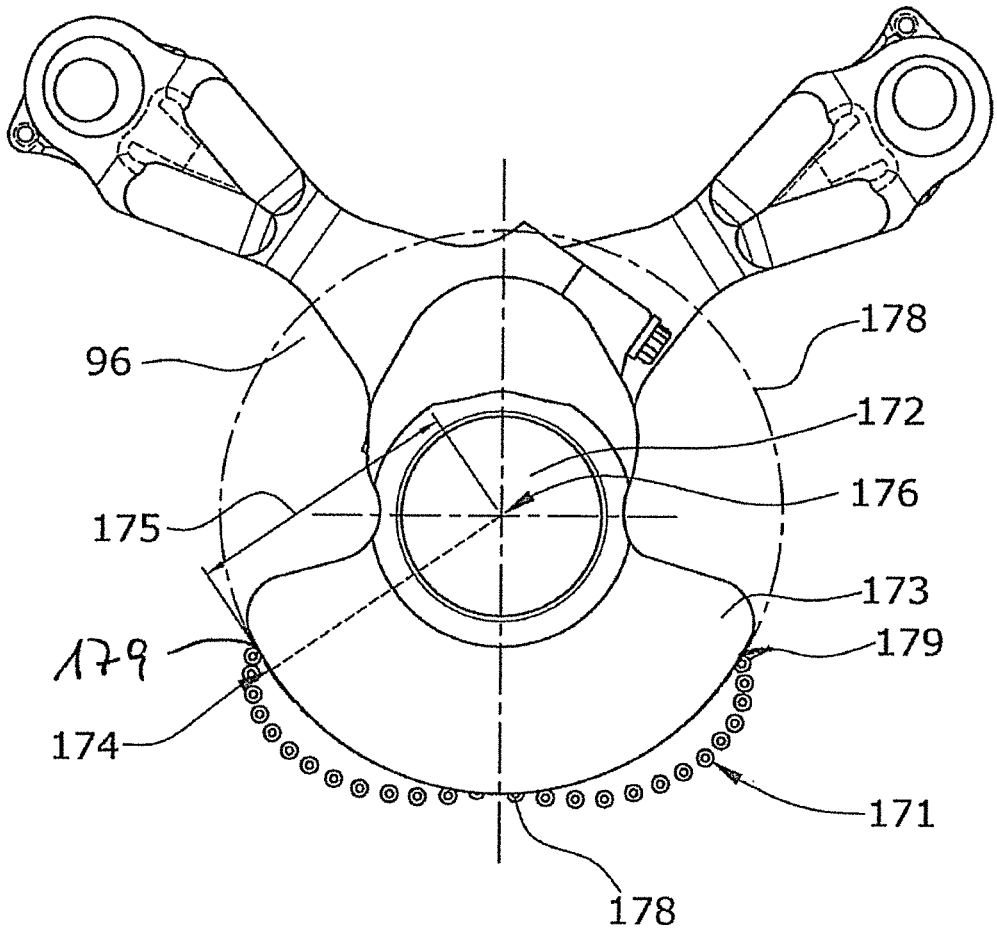
FIG. 8 is a trajectory for the switchover element of the connecting rod shown in FIG. 7.

FIG. 8 illustrates a trajectory 171 by way of example for the switchover element 91 during a revolution of the connecting rod 96. FIG. 8 furthermore illustrates a crankshaft 172, on which a counterweight 173 is arranged. The counterweight 173 has at least one extent 174 with a maximum distance 175 from the crankshaft center line 176. During one full revolution of the connecting rod 96, the switchover element 91 moves along the trajectory 171, which intersects a circle 178 that has a radius that is equal to the maximum distance 175 of the extent 174 of the counterweight 173. The points of intersection of the trajectory 171 with the circle 178 are illustrated by the points 179 in FIG. 8.

Figure 9:
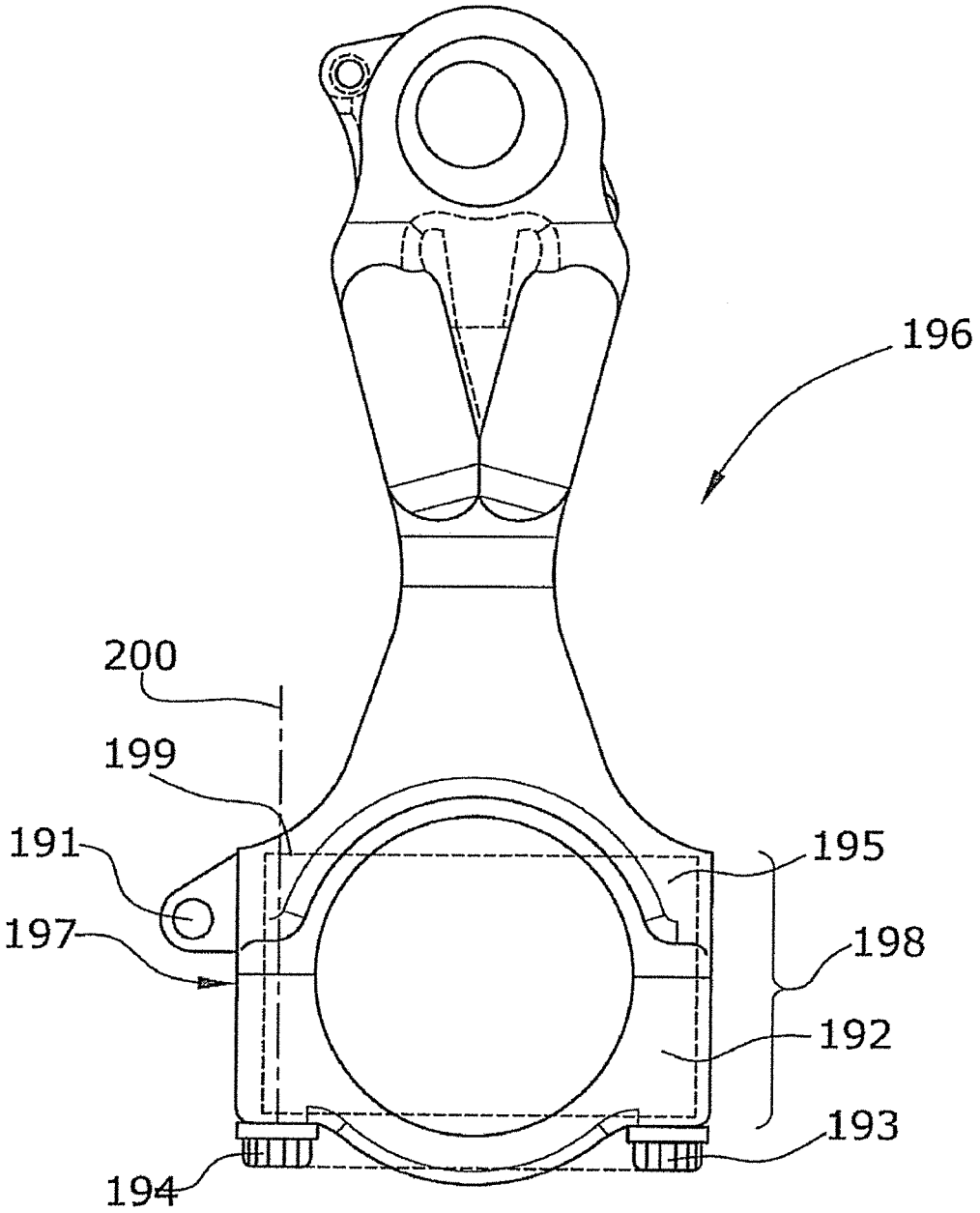
FIG. 9 is a third possible arrangement of a switchover element in the region of the crankshaft connecting-rod bearing in the case of a horizontally opposed engine.

FIG. 9 illustrates a third arrangement of a switchover element 191 on a connecting rod bearing cap 192 of a connecting rod 196, which is secured on a connecting rod big end 195 of the connecting rod 196 by means of a first screw 193 and of a second screw 194. Switchover element 191 is provided on the connecting rod big end 195, preferably on a narrow side face 197 of the connecting rod head 198, which is formed by the connecting rod bearing cap 192 and the connecting rod big end 195. A wide side face of the connecting rod head 198 is illustrated by means of the dashed line 199. The arrangement of the switchover element 191 which is shown in FIG. 9 is provided, for example, for an internal combustion engine embodied as a horizontally opposed engine.

In a preferred embodiment, the switchover element 191 is spaced apart from the screw center line 200 of the nearest screw 194, by a distance of at least 0.5 cm, in a further embodiment at least 1 cm, in a modification different therefrom at least 1.5 cm and, in a further embodiment, at least 2 cm.

Figure 10:
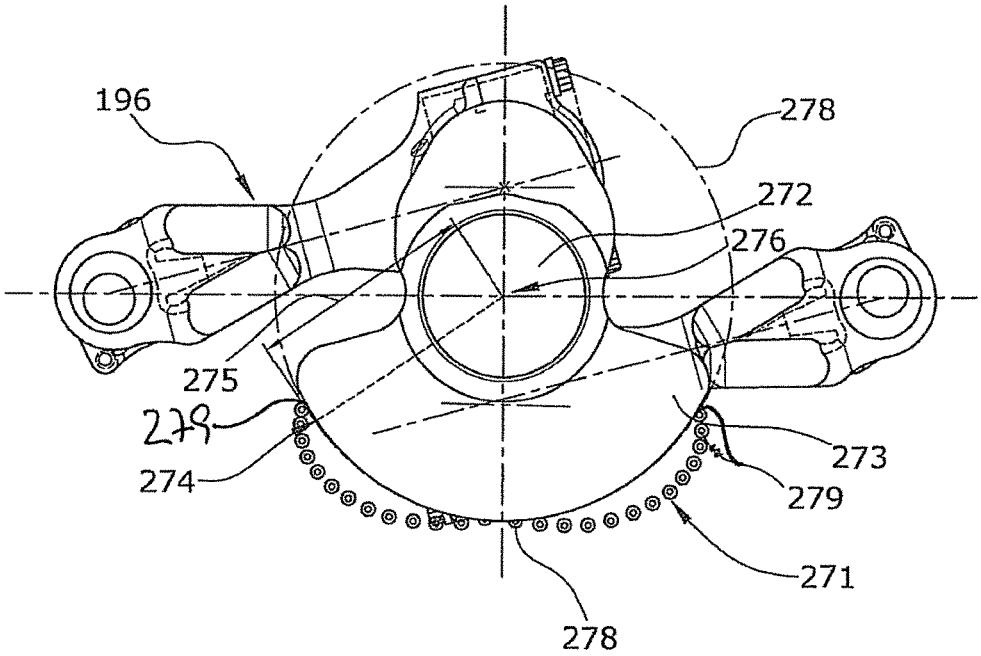
FIG. 10 is a trajectory for the switchover element of the connecting rod shown in FIG. 9.

FIG. 10 illustrates a trajectory 271 by way of example for switchover element 191 during a revolution of the connecting rod 196. FIG. 10 furthermore illustrates a crankshaft 272, on which a counterweight 273 is arranged. The counterweight 273 has at least one extent 274 with a maximum distance 275 from the crankshaft center line 276. During one revolution of the connecting rod 196, switchover element 191 moves along the trajectory 271, which intersects a circle 278 that has a radius that is equal to the maximum distance 275 of the extent 274 of the counterweight 273. The points of intersection of the trajectory 271 with the circle 278 are illustrated by the points 279 in FIG. 10.

As an alternative, the invention can be described by one of the groups of features stated below, wherein the groups of features can be combined in any desired way, and individual features of a group of features can also be combined with one or more features of one or more other groups of features and/or with one or more of the abovementioned embodiments of the invention.

An internal combustion engine having an adjustable variable compression ratio, a crankshaft 2 having a crankshaft center line and at least one counterweight, which has an extent with a maximum distance from the crankshaft center line, at least one connecting rod 3, an adjusting mechanism 4 for adjusting the adjustable variable compression ratio, a switchover element 5 for switching the adjusting mechanism 4, wherein the switchover element 5 is arranged on the connecting rod 3, and an actuating element for switching over the switchover element 5 from a first position into a second position, wherein the switching element describes a closed curve during one full revolution of the connecting rod, which curve, when viewed in the axial projection of the crankshaft, intersects a circle with a radius which is equal to the maximum distance of the counterweight from the crankshaft center line.

The internal combustion engine according to the above, wherein the connecting rod has a connecting rod bearing cap and the switching element is arranged on the connecting rod bearing cap.

The internal combustion engine according to the above, wherein the connecting rod has a connecting rod big end, the connecting rod bearing cap is secured on the connecting rod big end by means of a first and a second screw, and the switching element is arranged on the connecting rod bearing cap between the two screws.

The internal combustion engine according to one of the above, wherein the connecting rod has a connecting rod big end, the connecting rod bearing cap is secured on the connecting rod big end by means of a first and a second screw, and one of the two screws, the first or the second screw, is arranged between the switching element and the other screw, either the second or, correspondingly, the first screw.

The internal combustion engine according to the above, wherein the switching element is arranged on the connecting rod big end.

The internal combustion engine according to the above, wherein the internal combustion engine is an in-line engine.

The internal combustion engine according to the above, wherein the internal combustion engine is a horizontally opposed engine.

The internal combustion engine according to the above, wherein the internal combustion engine has two cylinder banks, which are arranged in a V shape.

A method for switching over an adjustable variable compression ratio of an internal combustion engine having a crankshaft 2 with a crankshaft center line and at least one counterweight, which extends as far as an outer counterweight radius starting from the crankshaft center line, a connecting rod 3 and an adjusting mechanism for adjusting the variable compression ratio, wherein a switchover element 5 for switching the adjusting mechanism is arranged on the connecting rod 3 and can be actuated by means of an actuating element, and the following steps: 1.) Switching over the actuating element 7 from a first into a second switchover position or from a second into a first switchover position; 2.) Making the connecting rod 3 rotate, wherein the switchover element 5 describes a closed curve during one full revolution of the connecting rod 3, which curve intersects the circumference of the outer counterweight radius of the counterweight and has a curve segment extending outside the circumference; and 3.) For switching the adjusting mechanism, the actuating element is brought into operative connection with the switchover element 5 within the interval during which the switchover element moves along its curve segment extending outside the circumference.

LIST OF REFERENCE SIGNS

1 housing
1' cylinder
2 crankshaft
3 connecting rod
3' compression piston
4 adjusting mechanism
5 switchover element
6 holder
7 actuating element
8 actuating surfaces
8' actuating surface
9 trajectory, curve line, curve
10 point
11 three/two-way valve
12 switch, two/two-way valve
13 two/two-way valve
14 tappet
15 tappet
16 latching device
17 pressure piece
18 latching contour
19 latching contour
20 switch

21 position
29 working chamber
30 connecting rod
36 outflow bore
41 speed profile
42 speed profile
51 switchover element
52 connecting rod bearing cap
53 screw
54 screw
55 connecting rod big end
56 side face
57 connecting rod head
58 connecting rod bearing receptacle
59 central point
60 connecting line
61 screw head end
62 screw head end
63 connecting rod
71 trajectory
72 crankshaft
73 counterweight
74 extent
75 distance
76 crankshaft center line
78 counterweight orbit
79 points of intersection
91 switchover element
92 connecting rod bearing cap
93 screw
94 screw
95 connecting rod big end
96 connecting rod
97 side face
98 connecting rod head
99 line
100 screw center line
171 trajectory
172 crankshaft
173 counterweight
174 extent
175 distance
176 crankshaft center line
178 orbital path
179 points of intersection
191 switchover element
192 connecting rod bearing cap
193 screw
194 screw
195 connecting rod big end
196 connecting rod
197 side face
198 connecting rod head
199 line
200 screw center line
271 trajectory
272 crankshaft
273 counterweight
274 extent
275 distance
276 crankshaft center line
278 orbital path
279 points of intersection

The invention claimed is:

1. A reciprocating piston engine, in particular an internal combustion engine, having a variable compression ratio, comprising:

a housing;

a crankshaft rotatably mounted on the housing and having at least one crankpin and a balance weight, the outer circumferential contour of the crankshaft which is radially furthest away from the crankshaft center line describes an orbital path when the crankshaft rotates;

a compression piston which is supported by a connecting rod and is guided in such a way as to be movable bidirectionally within a cylinder formed in the housing;

an adjusting mechanism—which is arranged on the connecting rod—for adjusting a compression ratio by selectively releasing or blocking or assisting a movement of the compression piston relative to the connecting rod, the adjusting mechanism having a pair of pistons mounted to the connecting rod, a two-way directional valve in fluid communication with the pair of pistons, the directional valve configured to switch a pressure between the pair of pistons so to adjust the adjustment mechanism, a switch which is arranged on or in the connecting rod having a control valve which can be actuated, in particular mechanically, for transferring the switch out of a first switching position, which corresponds to a first compression ratio, into at least one second switch position, which corresponds to a second compression ratio different from the first compression ratio, and vice versa; and an actuating element having a pair of spaced apart surfaces contacting respective ends of the control valve, wherein the connecting rod has, in the region around a crankshaft connecting-rod bearing, a connecting rod portion which, during a revolution of the connecting rod along a curve line and over at least one segment of the curve line is outside the orbital path of the balance weight;

wherein the control valve for the switch is arranged within the connecting rod portion, and wherein the actuating element is arranged within a region which is aligned with the segment of the curve line when the crankshaft is viewed in an axial projection thereof.

2. The reciprocating piston engine according to claim 1, wherein the control unit for the switch describes a closed curve line during a revolution of the connecting rod and in that this curve intersects the orbital path of the balance weight at least two points when viewed in the axial projection of the crankshaft.

3. The reciprocating piston engine according to claim 1, wherein the connecting rod has a connecting rod shank having a rotary bearing for the compression piston, a connecting rod big end and a connecting rod bearing cap, wherein the connecting rod big end and the connecting rod bearing cap form the crankshaft connecting-rod bearing and the region of the connecting rod around the crankshaft connecting-rod bearing, and in that the connecting rod big end and the connecting rod bearing cap are connected mechanically to one another by at least two connecting elements arranged on both sides of the crankshaft connecting-rod bearing.

4. The reciprocating piston engine according to claim 3 wherein the housing has a plurality of cylinders arranged in the manner of an in-line engine and having respectively associated compression pistons and connecting rods and in that at least one of the connecting rods has a switch having a control valve which is arranged on the connecting rod bearing cap and, in particular, in the region thereof between the at least two connecting elements.

5. The reciprocating piston engine according to claim 3 wherein the housing has a plurality of cylinders arranged in the manner of a V engine and having respectively associated compression pistons and connecting rods and in that at least one of the connecting rods has a switch having a control valve which is arranged on the connecting rod bearing cap and, in particular, in the region thereof between the at least two connecting elements or on the side of at least one of the connecting elements facing away from the crankshaft connecting-rod bearing, or on the connecting rod big end on the side of the at least one connecting element facing away from the crankshaft connecting-rod bearing.

6. The reciprocating piston engine according to claim 3 wherein the housing has a plurality of cylinders arranged in the manner of a horizontally opposed engine and having respectively associated compression pistons and connecting rods and in that at least one of the connecting rods has a switch having a control valve which is arranged on the connecting rod big end on the side of at least one of the connecting elements facing away from the crankshaft connecting-rod bearing.

* * * * *